US009388990B2

(12) United States Patent
Kim et al.

(10) Patent No.: US 9,388,990 B2
(45) Date of Patent: Jul. 12, 2016

(54) METAL PANEL, MANUFACTURING METHOD THEREOF AND COOKING DEVICE USING THE METAL PANEL

(75) Inventors: Hyung Jin Kim, Pohang-si (KR); Yong Hyun Kwon, Yongin-si (KR); Seok Weon Hong, Yongin-si (KR); Tae Uk Lee, Hwaseong-si (KR); Pung Yeun Cho, Suwon-si (KR); Han Seong Kang, Hwasung-si (KR); Sung Soo Park, Hwaseong-si (KR); Han Jun Sung, Yongin-si (KR); Sung Kwang Kim, Ansan-si (KR); Tae Hun Kim, Seoul (KR); Min Jae Kang, Cheongju-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 1824 days.

(21) Appl. No.: 12/216,633

(22) Filed: Jul. 8, 2008

(65) Prior Publication Data

US 2009/0078244 A1 Mar. 26, 2009

(30) Foreign Application Priority Data

Sep. 21, 2007 (KR) ..... 10-2007-96896

(51) Int. Cl.

| | |
|---|---|
| ***F23M 7/00*** | (2006.01) |
| ***F23C 15/00*** | (2006.01) |
| ***E06B 7/28*** | (2006.01) |
| ***F24C 15/02*** | (2006.01) |
| ***E06B 3/82*** | (2006.01) |

(52) U.S. Cl.

CPC ..... *F24C 15/02* (2013.01); *E06B 3/827* (2013.01); *Y10T 29/49826* (2015.01)

(58) Field of Classification Search

CPC ..... F24C 15/02; E06B 3/827
USPC ..... 126/190, 19 R; 248/247, 248, 544; 52/635, 459

See application file for complete search history.

(56) References Cited

U.S. PATENT DOCUMENTS 1,313,387 A * 8/1919 Kaarbo ..... 220/4.06
1,651,542 A * 12/1927 Pittman ..... F24C 15/02 126/191
2,253,384 A * 8/1941 Lown ..... F24C 15/02 219/91.2

(Continued)

FOREIGN PATENT DOCUMENTS

DE 103 03 131 A1 7/2004
EP 2 109 277 6/1993

(Continued)

OTHER PUBLICATIONS

European Search Report issued on Feb. 3, 2009 in corresponding European Patent Application 08160036.3.

(Continued)

*Primary Examiner* — William G Corboy
(74) *Attorney, Agent, or Firm* — Staas & Halsey LLP

(57) ABSTRACT

A metal panel, a manufacturing method thereof and a cooking device using the metal panel capable of improving an external appearance of edges, enhancing efficiency of a manufacturing process and reducing the manufacturing cost. The manufacturing method of a metal panel includes cutting a metal plate to form a cutaway portion at a specified area of a border, bending the border on opposite sides of the cutaway portion, and coupling a bracket to a cutaway groove formed at the border by the bending.

4 Claims, 6 Drawing Sheets

(56) References Cited

U.S. PATENT DOCUMENTS

| | | | | |
|---|---|---|---|---|
| 2,553,922 | A * | 5/1951 | Koontz | 52/792.11 |
| 4,196,952 | A * | 4/1980 | Crowe | 312/236 |
| 5,331,717 | A * | 7/1994 | Joslin et al. | 16/35 R |
| 7,870,672 | B1 * | 1/2011 | Braun | 29/897.32 |
| 2002/0166334 | A1 * | 11/2002 | Houk et al. | 62/291 |

FOREIGN PATENT DOCUMENTS

| | | |
|---|---|---|
| GB | 2 109 277 A | 6/1983 |
| JP | 3-497 | 1/1991 |
| JP | 3-497 | 1/1997 |
| JP | 9-27686 | 1/1997 |
| JP | 2003-318567 | 11/2003 |
| JP | 2003-318657 | 11/2003 |
| KR | 10-0311936 | 9/2001 |

OTHER PUBLICATIONS

European Search Report issued Apr. 22, 2009 in corresponding European Patent Application 08160036.3.

* cited by examiner

METAL PANEL, MANUFACTURING METHOD THEREOF AND COOKING DEVICE USING THE METAL PANEL

CROSS-REFERENCE TO RELATED APPLICATIONS

This application claims the benefit of Korean Patent Application No. 2007-0096896, filed on Sep. 21, 2007 in the Korean Intellectual Property Office, the disclosure of which is incorporated herein by reference.

BACKGROUND

1. Field

The present invention relates to a metal panel, a manufacturing method thereof and a cooking device using the metal panel, and, more particularly, to the manufacture of an edge portion of the metal panel.

2. Description of the Related Art

Generally, an oven range is a cooking device with an oven and a range formed as a single body, in which the oven heats cooking ingredients in a sealed cooking chamber and the range directly heats and cooks cooking ingredients disposed on a gas burner or an electric heater. Oven ranges may be largely classified into a gas oven range and an electric oven range according to their heat sources.

A conventional oven range includes an oven unit which cooks food accommodated in a cooking chamber by thermal convection; a top burner unit which is disposed at an upper portion of the oven unit to directly heat a container containing food and cook the food; and a drawer unit which is disposed at the lower side of the oven unit to perform a storage function or a simple cooking function. An oven door is disposed at the open front of the cooking chamber to open and close the cooking chamber. The oven door includes a see-through window to allow a user to see food during cooking and a door frame forming a border of the see-through window.

In the conventional oven range, however, when the door frame is manufactured using a metal material for general processing, it is difficult to process an edge portion at which a front surface, side surfaces and an upper surface meet each other.

That is, when an edge portion is formed using a metal material for general processing, for example, stainless steel, used in the door frame of the conventional oven range or a metal material for seam processing, which has a small thickness equal to or less than about 0.8 mm, there is a problem that the edge portion is torn. Accordingly, in order to prevent the edge portion from being torn, the edge of the metal material is cut and bent to separate upper, lower and side surfaces of the edge. A welding process and a polishing process are performed on the separated upper, lower and side surfaces to from an external appearance of the door frame.

However, the door frame of the conventional oven range, which is manufactured such that the upper, lower and side surfaces are separated, has low impact strength and a sharp edge portion. Thus, there is a problem that a consumer may be injured in the opening and closing of the oven door.

Further, in the door frame of the oven range which is formed by a manufacturing method wherein the upper, lower and side surfaces are welded and polished, since the welding of the edge is not easy, the welding cost increases. Further, since a surface polishing process should be performed after welding, there is a problem such as a reduction of productivity.

The above problems may be generated in various electric and electronic products using a metal plate manufactured to form an edge portion in addition to a cooking device such as an oven range.

SUMMARY

The present invention has been made in order to solve the above problems. It is an aspect of the invention to provide a metal panel with no sharp edge portion, a manufacturing method thereof and a cooking device using the metal panel.

In accordance with an aspect of the invention, there is provided a manufacturing method of a metal panel including: cutting a metal plate to form a cutaway portion at a specified area of a border; bending the border on opposite sides of the cutaway portion; and coupling a bracket to a cutaway groove formed at the border by the bending.

The bracket may include a protruding portion corresponding to the cutaway groove and an extending portion extended from the protruding portion, and the bracket may be coupled to the cutaway groove by welding the extending portion to a circumferential side of the cutaway groove.

A height of the protruding portion may be formed to be substantially equal to a height of an outer surface of the cutaway groove.

The cutaway portion may be formed at a corner of the metal plate.

A lower portion of the cutaway portion may be cut to have a specified height higher than a bending line on one side surface of the metal plate, and the lower portion of the cutaway portion adjacent to the bending line on opposite side surfaces may be doubly bent.

The corner may be formed at a substantially right angle.

In accordance with another aspect of the invention, there is provided a metal panel including: a metal plate which has an edge formed as a single body by bending a border of one side surface and a cutaway groove at a specified area of the border; and a bracket which is coupled to the cutaway groove.

A cutaway portion may be formed at one side of the border of the metal plate and the metal plate is bent to form the cutaway groove adjacent to the edge.

The bracket may include a protruding portion which is inserted into the cutaway groove and an extending portion which is extended from the protruding portion and welded to a circumferential side of the cutaway groove.

An outer surface of the protruding portion may have a height substantially equal to a height of an outer surface around the cutaway groove.

The metal plate may be formed of stainless steel.

In accordance with yet another aspect of the invention, there is provided an oven range, serving as a cooking device, including a cooking chamber and a door which has a metal panel forming a front surface to open and close the cooking chamber, wherein the metal panel of the door includes a metal plate which has a cutaway groove formed at a specified area of any one surface of opposite side surfaces in which an edge is formed by bending, and a bracket which is coupled to the cutaway groove.

The cutaway groove may be positioned adjacent to the edge formed by bending.

The bracket may include a protruding portion which is inserted into the cutaway groove and an extending portion which is extended from the protruding portion and welded to a circumferential side of the cutaway groove.

An outer surface of the protruding portion may have a height substantially equal to a height of an outer surface around the cutaway groove.

As described above, in the metal panel, the manufacturing method thereof and the cooking device using the metal panel according to the present invention, the bracket is coupled to the cutaway groove of the edge side. Accordingly, since welding and polishing processes of the edge can be emitted, it is possible to simplify the manufacturing process and reduce the manufacturing cost. Further, there is an effect of protecting a consumer from accidents by removing a cut surface of a sharp edge portion.

Additional aspects and/or advantages of the invention will be set forth in part in the description which follows and, in part, will be apparent from the description, or may be learned by practice of the invention.

BRIEF DESCRIPTION OF THE DRAWINGS

These and/or other aspects and advantages of the exemplary embodiments of the invention will become apparent and more readily appreciated from the following description of the embodiments, taken in conjunction with the accompanying drawings, of which.

DETAILED DESCRIPTION OF THE EMBODIMENTS

Figure 1:
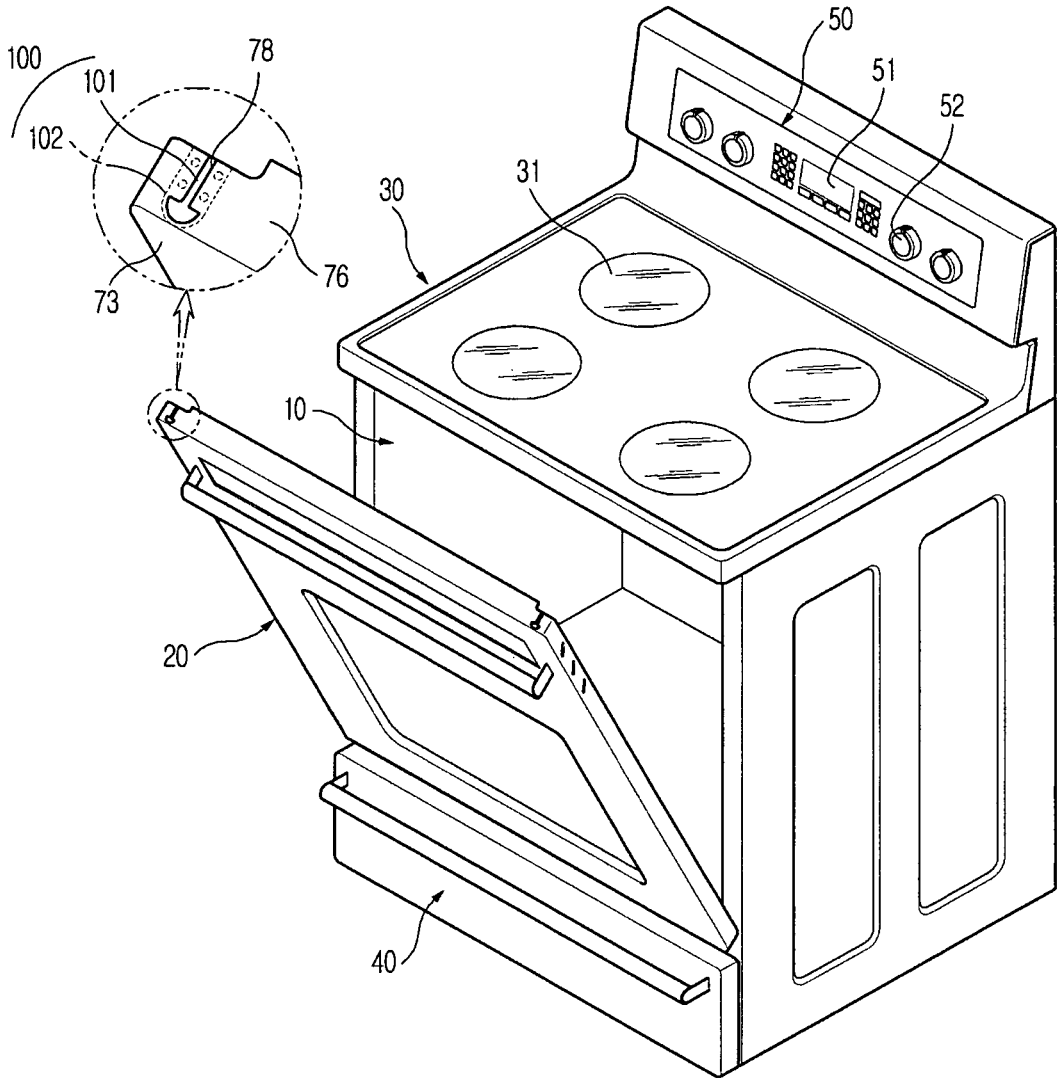
FIG. 1 illustrates a perspective view of a cooking device according to an embodiment of the present invention.

Reference will now be made in detail to exemplary embodiments of the present invention, examples of which are illustrated in the accompanying drawings, wherein like reference numerals refer to like elements throughout. The embodiments are described below to explain the present invention by referring to the figures.

Hereinafter, embodiments of the present invention will be described in detail with reference to the accompanying drawings.

Figure 2:
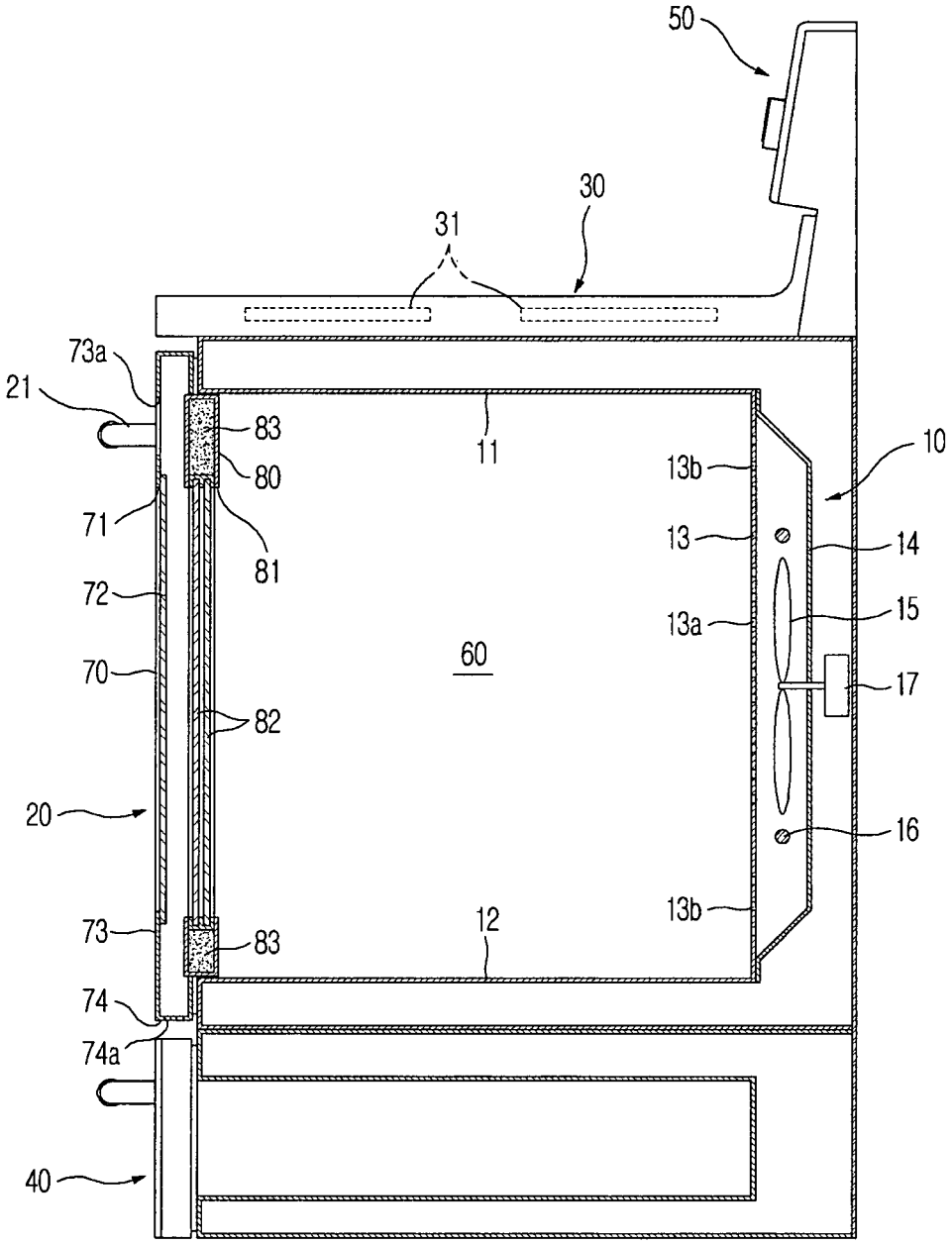
FIG. 2 illustrates a side cross-sectional view of the cooking device according to the embodiment of the present invention.

FIG. 1 illustrates a perspective view showing an external appearance of a cooking device according to the present invention. FIG. 2 illustrates a side cross-sectional view showing a configuration of the cooking device according to the present invention.

As shown in FIG. 1, the cooking device according to the present invention includes an oven unit 10 which heats and cooks food in a sealed state; an oven door 20 which opens and closes the oven unit 10; a top burner unit 30 disposed at the upper side of the oven unit 10 to cook food while supporting a container containing the food; a drawer unit 40 disposed at the lower side of the oven unit 10 to perform a storage function or a simple cooking function; and a controller 50 disposed at the rear of the top burner unit 30 to control an operation of the cooking device.

Electrical burners 31 are installed on the top burner unit 30 to heat food disposed thereon. The controller 50 includes a display 51 to display an operation state of the cooking device and a series of operation knobs 52 to control an operation of an oven range. The drawer unit 40 is provided in a drawer shape. The drawer unit 40 may include an additional heater (not shown) installed therein to warm cooked food or perform simple cooking.

The oven unit 10 cooks food by thermal convection. As shown in FIG. 2, the oven unit 10 includes a cooking chamber 60 defined by an upper plate 11, a bottom plate 12, both side plates (not shown) and a rear plate 13.

A fan cover 14 is coupled to the outside of the rear plate 13, and a convection fan 15 is provided between the fan cover 14 and the rear plate 13 to circulate air in the cooking chamber 60. An electric heater 16 is installed at an outer periphery of the convection fan 15 and a fan motor 17 is installed at the rear of the fan cover 14 to operate the convection fan 15.

A number of suction holes 13*a* are formed at a central portion of the rear plate 13 facing the convection fan 15 to suck air in the cooking chamber 60, and a number of discharge holes 13*b* are formed at a periphery of the rear plate 13 to supply heat into the cooking chamber.

The oven door 20 is disposed to be vertically rotatable at the front of the cooking chamber 60 of the cooking device according to the present invention to open and close the oven unit 10. The oven door 20 includes a first metal panel 70 and a second metal panel 80 which form a front external appearance and a rear external appearance, respectively. Openings 71 and 81 are formed at central portions of the first metal panel 70 and the second metal panel 80, respectively. See-through windows 72 and 82 are installed at the openings 71 and 81, respectively, such that a user can observe the inside of the cooking chamber 60 through the oven door 20.

The see-through windows 72 and 82 include a rear see-through window 82 installed at the second metal panel 80 and a front see-through window 72 installed at the first metal panel 70. The rear see-through window 82 is formed of a pair of heat reflective glasses capable of preventing heat leakage by reflecting heat generated in the cooking chamber 60 into the cooking chamber 60 again. The front see-through window 72 is formed of heat resistant tempered glass so as not to be easily deformed by heat transferred from the cooking chamber 60.

Meanwhile, a door handle 21 is installed at a front upper portion of the first metal panel 70 such that the user can grasp the door handle 21 in the opening and closing of the oven door 20. A thermal insulator 83 is disposed at the border of the rear see-through window 82 to prevent heat inside the cooking chamber 60 from being transferred into an outer space through the oven door 20.

Further, an outlet port 73*a* is formed at an upper portion of a front surface 73 of the first metal panel 70 to discharge hot air in a separation space between the front see-through window 72 and the rear see-through window 82 to an outer space. An inlet port 74*a* is formed on a bottom surface 74 of the first metal panel 70 to introduce exterior air between the front see-through window 72 and the rear see-through window 82.

Thus, the air heated in the separation space between the front see-through window 72 and the rear see-through window 82 rises to be discharged to the outside through the outlet port 73*a* formed at the upper portion of the front surface 73 of the first metal panel 70. In this case, exterior air is introduced into the separation space with a decreased pressure through the inlet port 74*a* formed the bottom surface 74 of the first metal panel 70. That is, the air between the front see-through window 72 and the rear see-through window 82 is convection circulated to prevent an increase in the temperature of the front surface of the oven door 20.

Figure 3:
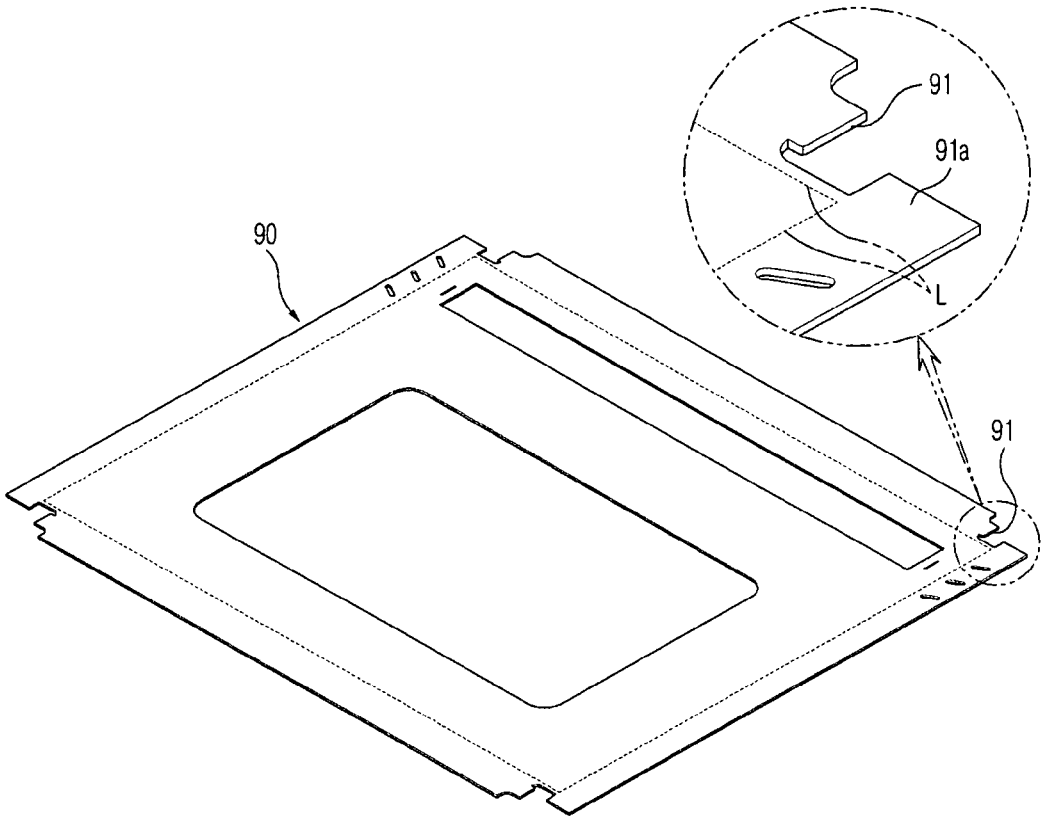
FIGS. 3 to 6 are diagrams for explaining a manufacturing method of a metal panel included in the cooking device according to the embodiment of the present invention.
Figure 4:
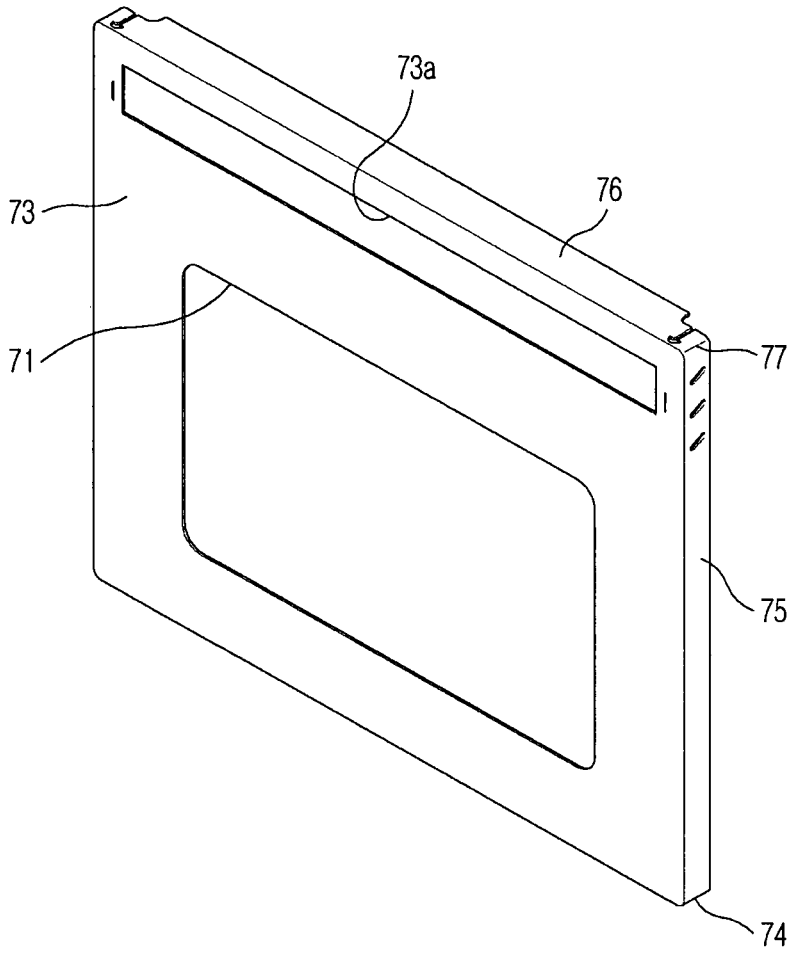

The first metal panel 70 is formed of a metal material such as stainless steel having high hardness by press processing. In order to form a shape desired to be finally formed, as shown in FIG. 3, a metal plate 90 is cut in a developed shape, and the border thereof is bent to form upper and lower surfaces 76 and 74 and side surfaces 75 as shown in FIG. 4.

In this case, the first metal panel 70 may be formed of another type of a metal material with a hardness comparable to stainless steel. Further, the first metal panel 70 may be formed of a metal material for seam processing, which causes the edge to be torn in press processing due to a small thickness (equal to or less than about 0.8 mm).

Figure 5:
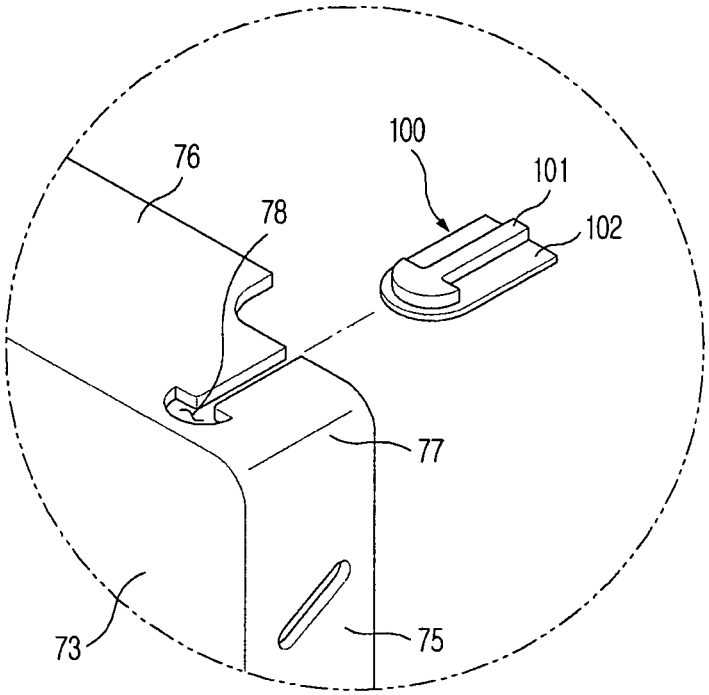
Figure 6:
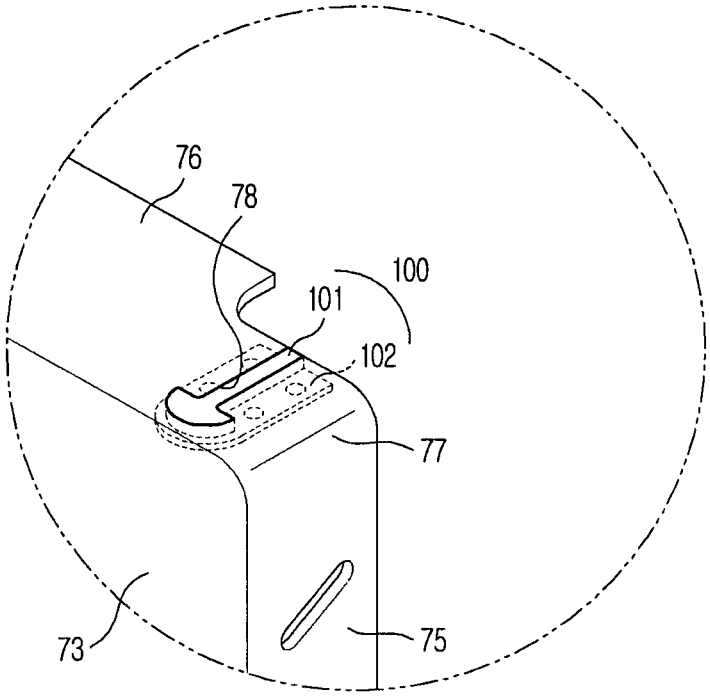

As shown in FIGS. 5 and 6, edges 77 at which the upper surface 76 and the side surfaces 75 of the first metal panel 70 meet each other are bent so as not to be sharp and cutaway grooves 78 is formed on the upper surface 76 adjacent to the edges 77. The cutaway grooves 78 are formed in the bending of the metal plate 90 according to the shape of cutaway portions 91 formed as in FIG. 3 in the cutting of the metal plate 90 to prevent the edges 77 from being torn in the bending of the metal plate 90. The cutaway grooves 78 may be formed in various shapes and sizes according to the shape of the cutaway portions 91.

Further, brackets 100 are inserted and coupled to the cutaway grooves 78 to cover the cutaway grooves 78. In this case, the brackets 100 are formed in a shape and a size corresponding to the cutaway grooves 78. The brackets 100 are fixed and coupled to the cutaway grooves 78, thereby preventing sharp cut surfaces of the cutaway portions 91 from being exposed to the outside.

Next, a method of manufacturing the first metal panel disposed on the front surface of the oven door of the cooking device according to the present invention will be described in detail.

In general, the first metal panel is manufactured using a thin metal plate for general processing, which is made of stainless steel or the like and has poor ductility to reduce the manufacturing cost. The edge is cut and the border is bent to prevent an edge portion from being torn in the processing of stainless steel. In this case, a gap is formed at the edge due to a cutaway portion. The gap is filled by welding and the sharp edge is polished by a polishing process to complete the manufacture of the first metal panel.

However, the manufacturing method is complicated and causes a problem such as an increase in the manufacturing cost. Accordingly, the embodiment of the present invention provides a relatively simple manufacturing method of the first metal panel capable of reducing the manufacturing cost.

FIGS. 3 to 6 are diagrams explaining a manufacturing method of a metal panel included in the cooking device according to the embodiment of the present invention.

First, the metal plate 90 is cut in a desired shape as in FIG. 3, that is, a developed shape of a metal panel desired to be finally formed. In this case, the outlet port 73*a* and the opening 71 are formed on the front surface of the metal plate 90 at the same time. The metal plate 90 may be formed of various metal plate materials such as stainless steel (SUS), electrogalvanized steel (SECC), hot-dipped galvanized steel (SGCC) or the like.

A general press method may be used as a cutting method, but it is preferable to use an N.C.T. machine to maintain accurate dimensions and realize the automation.

The cutaway portions 91 are formed at the edge side of the cut metal plate 90 to prevent the metal plate from being torn in the bending. The cutaway portions 91 are formed in a specified shape such that the cutaway grooves 78 are formed on the upper surface 76 of the first metal panel 70 after the bending of the metal plate 90. In this case, the cutaway portions may be formed such that the cutaway grooves are formed on the side surfaces of the metal panel.

Next, a border portion of the cut metal plate 90 is bent as in FIG. 4 using a molding machine.

The molding machine is formed in an approximately rectangular shape corresponding to the front surface 73 of the metal plate 90. The cut metal plate 90 is disposed on the molding machine and press processed, thereby bending each side of the border of the metal plate 90 at a right angle to form the upper and lower surfaces 76 and 74 and the side surfaces 75.

The molding machine and a press machine used in this case may be easily configured by those skilled in the art according to the size and shape of the metal panel to bend the border side of the metal plate 90. The material of the molding machine may vary according to the material of the metal plate.

When the border is bent, the cutaway portions 91 formed at the edge side in the cutting process form the cutaway grooves 78 by bending as shown in FIG. 4.

In this case, lower portions 91*a* of the cutaway portions 91 are cut to have a specified height higher than a bending line L on one side surface of the metal plate 90. Accordingly, when the metal plate 90 is bent, the lower portions 91*a* of the cutaway portions 91 adjacent to the bending line L on the opposite side surfaces are doubly bent.

Then, as shown in FIG. 6, the brackets 100 are inserted into the cutaway grooves 78 adjacent to the edges 77, which are formed by the cutaway portions 91, and coupled thereto by welding to complete the manufacture of the first metal panel 70. In this case, spot welding may be performed in the welding. Preferably, the brackets 100 are inserted and coupled to the cutaway grooves 78 by projection welding to prevent traces of welding from being formed on an external appearance of the first metal panel 70.

In this case, as shown in FIG. 5, the brackets 100 have a shape corresponding to the cutaway grooves 78 and are inserted into the cutaway grooves 78. The brackets 100 include protruding portions 101 having a height approximately equal to a thickness of the metal plate 90 and extending portions 102 which are formed around the protruding portions 101 and are extended therefrom such that the brackets 100 can be inserted into the cutaway grooves 78.

Accordingly, the protruding portions 101 of the brackets 100 are inserted into the cutaway grooves 78 of the upper surface 76 of the first metal panel 70, and the projection welding is performed on the extending portions 102 and the upper surface 76, whereby the brackets are coupled to the upper surface of the first metal panel. In this case, the protruding portions 101 of the brackets 100 are not protruded from the upper surface 76 of the first metal panel 70 and outer surfaces of the protruding portions 101 of the brackets 100 have a height approximately equal to a height of the upper surface 76 on the circumferential side of the cutaway grooves 78 of the first metal panel 70, thereby improving an external appearance.

The manufacturing method may be used in the manufacture of a metal panel formed on a front surface of the drawer unit in addition to the first metal panel. Accordingly, an upper edge of the drawer unit may also have the same shape as that of the first metal panel.

The oven door is configured using the first metal panel manufactured as described above, thereby forming the edge having a different shape from the edge of a conventional oven door to improve an external appearance. Further, since the welding process and the polishing process of the edge can be emitted, it is possible to simplify the manufacturing process and reduce the manufacturing cost.

Further, there is an effect of protecting a consumer from accidents by removing the cut surface of the sharp edge portion.

In the above-described manufacturing method of a metal panel, a metal plate for general processing, which is made of a relatively inexpensive material with hardness, is manufactured into a case, a metal panel or the like, and brackets are coupled to cutaway grooves of bent edges, thereby removing a sharp edge portion.

Thus, when the metal panel produced by the manufacturing method of a metal panel according to the present invention is applied to a panel and a case of electric and electronic products having an external appearance capable of being contacted with the consumer, there is an effect of reducing the manufacturing cost.

Although embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A metal panel assembly for a door of an oven range, wherein:

the door includes a first metal panel and a second metal panel to form a front external appearance and a rear external appearance, respectively, and to open and close the cooking chamber, the first metal panel includes a front surface, side surfaces and upper and lower surfaces, the side surfaces and the upper and lower surfaces being bent from the front surface toward the second metal panel and forming a border of the first metal panel, and a cutaway groove is formed, before bending of the first metal panel, at an edge of any one surface of the side surfaces and the upper and lower surfaces, and a bracket is coupled to the cutaway groove to cover the cutaway groove, the cutaway groove, which is formed at an edge of any one surface of the side surfaces and the upper and lower surfaces, is formed away from corners of any one surface of the side surfaces and the upper and lower surfaces after bending of the first metal panel, and the bracket includes a protruding portion which is inserted into the cutaway groove, the protruding portion comprising a rectangular shaped section and a semicircular shaped section and an extending portion which is extending from the protruding portion and welded to a circumferential side of the cutaway groove.

2. The metal panel assembly according to claim 1, wherein an outer surface of the protruding portion has a height substantially equal to a height of an outer surface around the cutaway groove.

3. The metal panel assembly according to claim 1, wherein the bracket has shape corresponding to the cutaway groove.

4. A metal panel assembly for a door of an oven range, wherein:

the door includes a metal plate, the metal plate having a border thereof bent to form upper, lower, left and right side surfaces, a cutaway groove being provided at a specified area of the border at an edge of at least one of the upper, lower, left and right side surfaces, a bracket is inserted into and coupled to the cutaway groove, the bracket includes a protruding portion having a rectangular portion integrally formed with a semicircular portion, wherein the metal plate includes an interior surface and an exterior surface, the bracket is fitted into the cutaway groove by being inserted toward the exterior surface of the metal plate from the interior surface of the metal plate, the bracket fitted into the cutaway groove is flush with the exterior surface of the metal plate, the cutaway groove, which is being provided at a specified area of the border at an edge of at least one of the upper, lower, left and right side surfaces, is being provided away from corners of any one surface of the side surfaces and the upper and lower surfaces after bending of the metal panel, and the bracket includes a protruding portion which is inserted into the cutaway groove, the protruding portion comprising a rectangular shaped section and a semicircular shaped section and an extending portion which is extending from the protruding portion and welded to a circumferential side of the cutaway groove.

* * * * *